US011753926B2

(12) United States Patent
Mishkhes et al.

(10) Patent No.: US 11,753,926 B2
(45) Date of Patent: Sep. 12, 2023

(54) METHOD AND SYSTEM FOR PREDICTING CALIPER LOG DATA FOR DESCALED WELLS

(71) Applicant: SAUDI ARABIAN OIL COMPANY, Dhahran (SA)

(72) Inventors: Abdulrahman T. Mishkhes, Dhahran (SA); Fuad A. AlSultan, Alahsa (SA); Mosab Al-Askar, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 140 days.

(21) Appl. No.: 17/365,191

(22) Filed: Jul. 1, 2021

(65) Prior Publication Data

US 2023/0003114 A1 Jan. 5, 2023

(51) Int. Cl.

| | |
|---|---|
| ***G06F 17/11*** | (2006.01) |
| ***E21B 47/00*** | (2012.01) |
| ***E21B 37/00*** | (2006.01) |

(52) U.S. Cl.

CPC ..... *E21B 47/006* (2020.05); *E21B 37/00* (2013.01); *E21B 2200/20* (2020.05)

(58) Field of Classification Search

CPC .. E21B 49/006; E21B 49/003; E21B 2200/20; E21B 47/006; E21B 37/00; G06F 17/11

See application file for complete search history.

(56) References Cited

U.S. PATENT DOCUMENTS 4,914,826 A * 4/1990 Nold, III ..... E21B 47/08 33/544.3
4,916,616 A * 4/1990 Freedman ..... E21B 49/00 73/152.08

(Continued)

FOREIGN PATENT DOCUMENTS

CN 106124397 A 11/2016
CN 106285586 A 1/2017

(Continued)

OTHER PUBLICATIONS

Castagnoli et al; "Drilling Geomechanics Salt Creep Monitoring: How to Optimize Mud Weight in Real Time and Geta Safe Time Window While Drilling, Tripping, Running and Cementing Casing in Salt Formations"; Link: https://www.searchanddiscovery.com/documents/2016/41954castagnoli/ndx_castagnoli.pdf (Year: 2016).*

(Continued)

*Primary Examiner* — Edwin J Toledo-Duran
(74) *Attorney, Agent, or Firm* — Osha Bergman Watanabe & Burton LLP

(57) ABSTRACT

A method may include obtaining caliper log data regarding a well. The method may further include determining, using a descaling model and the caliper log data, various predicted caliper log values for a descaled well. The descaled well may correspond to the well following a scale treatment. The method may further include determining whether the descaled well satisfies a predetermined criterion based on the predicted caliper log values. The method may further include determining, in response to determining that the descaled well fails to satisfy the predetermined criterion, a tubular replacement for the well. The method may further include transmitting, to a control system, a command that implements the tubular replacement.

18 Claims, 6 Drawing Sheets

(56) References Cited

U.S. PATENT DOCUMENTS 5,038,033 A * 8/1991 Carroll ..... E21B 47/11 166/250.17
5,072,388 A * 12/1991 O'Sullivan ..... E21B 47/085 73/598
6,078,867 A * 6/2000 Plumb ..... G01V 1/50 702/6
6,109,368 A * 8/2000 Goldman ..... E21B 49/003 702/9
6,179,069 B1 * 1/2001 Zheng ..... E21B 21/00 166/308.1
6,408,953 B1 * 6/2002 Goldman ..... E21B 49/003 702/9
6,671,623 B1 * 12/2003 Li ..... G01V 3/20 702/7
6,880,402 B1 * 4/2005 Couet ..... E21B 34/066 73/1.49
7,066,019 B1 * 6/2006 Papanastasiou ..... E21B 49/006 73/152.59
7,147,068 B2 * 12/2006 Vail, III ..... E21B 10/64 175/171
8,725,477 B2 5/2014 Zhang et al.
9,784,885 B2 * 10/2017 Al-Ajmi ..... G06F 30/20
10,114,144 B2 * 10/2018 Vasquez ..... G01V 5/101
11,098,235 B1 * 8/2021 Alanqari ..... E21B 33/14
11,549,361 B2 * 1/2023 Han ..... E21B 49/006
2001/0042642 A1 * 11/2001 King ..... E21B 44/00 175/48
2002/0070337 A1 * 6/2002 Fitzgerald ..... G01V 5/04 250/256
2003/0074139 A1 * 4/2003 Poedjono ..... G01V 1/44 702/16
2005/0126777 A1 * 6/2005 Rolovic ..... E21B 47/10 166/255.1
2005/0150689 A1 * 7/2005 Jogi ..... E21B 47/007 175/45
2006/0131074 A1 * 6/2006 Calhoun ..... E21B 49/006 175/50
2006/0149478 A1 * 7/2006 Calhoun ..... E21B 45/00 702/9
2008/0319675 A1 * 12/2008 Sayers ..... G01V 1/50 702/11
2009/0006058 A1 * 1/2009 King ..... E21B 12/02 703/10
2011/0153296 A1 * 6/2011 Sadlier ..... E21B 44/00 702/9
2011/0253364 A1 * 10/2011 Mosse ..... G01V 5/125 175/50
2012/0326017 A1 * 12/2012 Nikitin ..... G01V 5/125 250/269.7
2012/0330551 A1 * 12/2012 Mitchell ..... E21B 47/022 702/9
2013/0032407 A1 * 2/2013 Edbury ..... E21B 44/06 175/61
2013/0087328 A1 * 4/2013 Maida, Jr. ..... G01N 21/78 422/53
2013/0275099 A1 * 10/2013 Frydman ..... G06F 30/20 703/2
2014/0177673 A1 * 6/2014 Bliss ..... F28G 15/003 374/165
2015/0090498 A1 * 4/2015 Hareland ..... E21B 45/00 175/48
2015/0315904 A1 * 11/2015 Manclossi ..... E21B 47/085 702/9
2015/0323697 A1 * 11/2015 Ohmer ..... E21B 47/08 324/333
2015/0330167 A1 * 11/2015 Marland ..... E21B 47/07 702/6
2016/0320769 A1 * 11/2016 Deffenbaugh ..... E21B 47/06
2017/0058668 A1 * 3/2017 Paul ..... E21B 49/00
2017/0101865 A1 4/2017 Khalaj Amineh et al.
2017/0108611 A1 * 4/2017 Vasquez ..... G01B 3/38
2017/0362492 A1 12/2017 Nasreldin Mahmoud et al.
2018/0045031 A1 * 2/2018 Shaposhnikov ..... E21B 33/14
2018/0142544 A1 * 5/2018 Kolchanov ..... E21B 47/005
2018/0252101 A1 * 9/2018 Bartetzko ..... E21B 44/00
2019/0017362 A1 * 1/2019 Liu ..... B08B 9/0326
2019/0085684 A1 * 3/2019 Fang ..... G06F 17/18
2019/0309614 A1 * 10/2019 Benson ..... E21B 49/005
2019/0323328 A1 * 10/2019 Rao ..... E21B 21/01
2020/0103374 A1 * 4/2020 Guner ..... E21B 47/113
2020/0254615 A1 * 8/2020 Bryner ..... B25J 13/088
2020/0378240 A1 12/2020 Fouda et al.
2021/0017857 A1 * 1/2021 Khan ..... E21B 49/003
2021/0302619 A1 * 9/2021 Al-Qahtani ..... E21B 44/00

FOREIGN PATENT DOCUMENTS

CN 107290270 A 10/2017
CN 108756817 A 11/2018
CN 110821473 A 2/2020
CN 111075426 A 4/2020
CN 112483069 A 3/2021

OTHER PUBLICATIONS

Rasheed, Wajid et al., "Smart Calliper for Measurement While Drilling"; Proceedings of the SPE/IADC Middle East Drilling Technology Conference & Exhibition; Paper No. SPE-166786-MS; pp. 1-11; Oct. 7-9, 2013 (11 pages).

Dyer, Sarah et al., "Prediction and optimisation of Pb/Zn/Fe sulphide scales in gas production fields"; Geilo Oilfield Chemicals Symposium; pp. 1-18; Mar. 2006 (18 pages).

Abbas, Abubakar Jibrin, "Descaling of Petroleum Production Tubing utilising Aerated High Pressure Flat Fan Water Sprays"; Submitted in Partial Fulfilment of the Requirements of the Degree of Doctor of Philosophy; pp. i-246; Nov. 2014 (270 pages).

Gamal, Hany et al., "New Environmentally Friendly Acid System for Iron Sulfide Scale Removal"; MDPI Open Access Journals: Sustainability 2019; vol. 11, Issue 23, 6727; pp. 1-13; Nov. 27, 2019 (13 pages).

* cited by examiner

METHOD AND SYSTEM FOR PREDICTING CALIPER LOG DATA FOR DESCALED WELLS

BACKGROUND

During hydrocarbon production, various types of scales may form on casing walls and joints in a well. For example, different reservoir types may result in scales based on iron sulfide, chloride, and/or sulfates. Scale formation may thus reduce a hydrocarbon flow rate out of a reservoir. To remove this scaling, various descaling operations may be performed. However, some descaling operations may prove both difficult and insufficient to restore a well to its prescaled state.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining, by a computer processor, caliper log data regarding a well. The method further includes determining, by the computer processor and using a descaling model and the caliper log data, various predicted caliper log values for a descaled well. The descaled well corresponds to the well following a scale treatment. The method further includes determining, by the computer processor, whether the descaled well satisfies a predetermined criterion based on the predicted caliper log values. The method further includes determining, by the computer processor and in response to determining that the descaled well fails to satisfy the predetermined criterion, a tubular replacement for the well. The method further includes transmitting, by the computer processor and to a control system, a command that implements the tubular replacement.

In general, in one aspect, embodiments relate to a method that includes obtaining, by a computer processor, caliper log data regarding a well. The method further includes determining, by the computer processor and using a descaling model and the caliper log data, various predicted caliper log values for a descaled well. The descaled well corresponds to the well following a scale treatment. The method further includes determining, by the computer processor, whether the descaled well satisfies a predetermined criterion based on the predicted caliper log values. The method further includes transmitting, by the computer processor, to a control system, and in response to determining that the descaled well satisfies the predetermined criterion, a command that implements the scale treatment at the well.

In general, in one aspect, embodiments relate to a system that includes a logging system coupled to a caliper logging tool and a well. The system further includes a control system coupled to the well. The system further includes a simulator including a computer processor. The simulator is coupled to the logging system and the control system. The simulator obtains, using the caliper logging tool, caliper log data regarding the well. The simulator determines, using a descaling model and the caliper log data, various predicted caliper log values for a descaled well. The descaled well corresponds to the well following a scale treatment. The simulator determines whether the descaled well satisfies a predetermined criterion based on the predicted caliper log values. The simulator transmits, in response to determining that the descaled well satisfies the predetermined criterion, a first command to the control system to perform the scale treatment. The simulator transmits, to a control system and in response to determining that the descaled well fails to satisfy the predetermined criterion, a second command that implements a tubular replacement.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
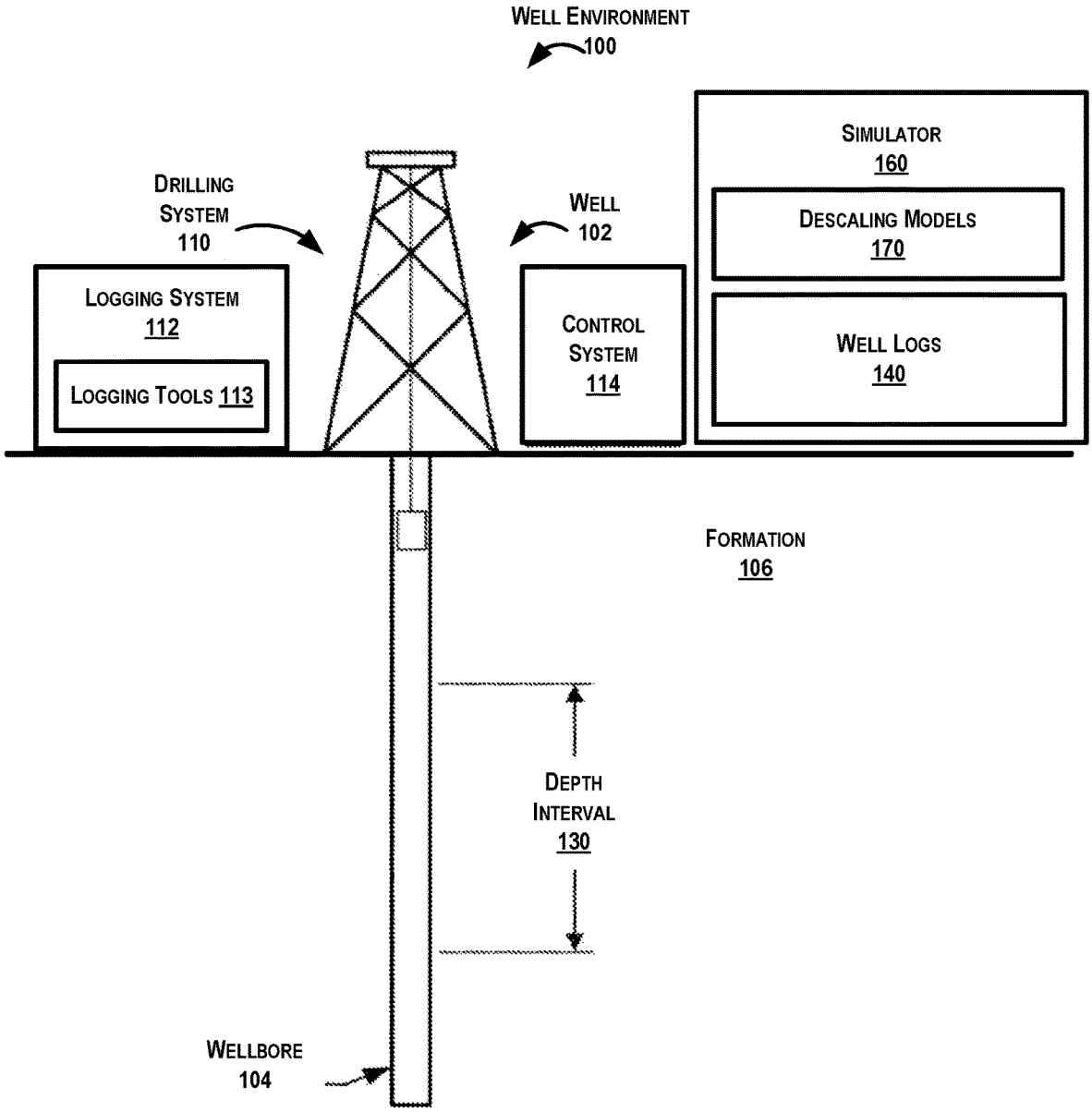
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for predicting caliper log data using a descaling model. To illustrate the problem of scaling in the oil and gas industry, scales on well components may be a problem of production flow assurance. Iron sulfide scaling, for example, may result from the presence of iron and hydrogen sulfide in sour oil and gas wells. Thus, some embodiments include using a descaling model to predict the outcome of one or more scale treatments for addressing different types of scaling, such as iron sulfide scaling. More specifically, caliper log data may be acquired in a wellbore for a well of interest, where the caliper log data may be input to the descaling model in order to simulate or predict values of the well after a scale treatment. In other words, a caliper logging tool may obtain radius values inside a well tubular for a scaled joint, which may be subsequently used to determine characteristics of the descaled joint (e.g., resulting thickness and other physical dimensions, maximum allowable operating pressure (MAOP) values, etc.) after a scale treatment. Using this predicted scale treatment knowledge, a control system or other well managing system may determine whether to perform a particular scale treatment or proceed with a well intervention operation to workover (e.g., replace) the well tubulars with the scaled joints. Example of well tubulars may include casings in a well as well as production tubing.

Furthermore, a descaling model may be a linear regression model that generates virtual caliper logs or merely individual predicted caliper log values. These virtual caliper logs may be synthetic data that are used to predict new tubing thicknesses after descaling. Accordingly, a predicted descaled well may be analyzed for various predetermined criteria, such as a new maximum allowable operating pressure (MAOP) on well tubing. If this new MAOP value is out of range from a recommended rating, a tubing replacement may be selected over a scale treatment in order to maintain tubing integrity.

Turning to FIG. 1, FIG. 1 shows a schematic diagram in accordance with one or more embodiments. As shown in FIG. 1, FIG. 1 illustrates a well environment (100) that may include a well (102) having a wellbore (104) extending into a formation (106). The wellbore (104) may include a bored hole that extends from the surface into a target zone of the formation (106), such as a reservoir. The formation (106) may include various formation characteristics of interest, such as formation porosity, formation permeability, resistivity, density, water saturation, and the like. The well environment (100) may include a drilling system (110), a logging system (112), a control system (114), and a simulator (160). The drilling system (110) may include a drill string, drill bit, a mud circulation system and/or the like for use in boring the wellbore (104) into the formation (106).

The control system (114) may include hardware and/or software for managing drilling operations, maintenance operations, and/or well intervention operations. For example, the control system (114) may include one or more programmable logic controllers (PLCs) that include hardware and/or software with functionality to control one or more processes performed by the drilling system (110). Specifically, a programmable logic controller may control valve states, fluid levels, pipe pressures, warning alarms, and/or pressure releases throughout a drilling rig. In particular, a programmable logic controller may be a ruggedized computer system with functionality to withstand vibrations, extreme temperatures, wet conditions, and/or dusty conditions, for example, around a drilling rig. Thus, controls systems may be used to perform various well operations, such as drilling operations, well completion operations, well intervention operations, and well maintenance operations.

The logging system (112) may include one or more logging tools (113), such as a nuclear magnetic resonance (NMR) logging tool and/or a resistivity logging tool, for use in generating well logs (140) of the formation (106) and/or well components in the wellbore (104), such as casings, production tubing, or other well tubulars. For example, a logging tool may be lowered into the wellbore (104) to acquire measurements as the tool traverses a depth interval (130) (e.g., a targeted reservoir section) of the wellbore (104). The plot of the logging measurements versus depth may be referred to as a "log" or "well log". Well logs (104) may provide depth measurements of the well (102) that describe such reservoir characteristics as formation porosity, formation permeability, resistivity, density, borehole or tubular sizes, water saturation, and the like. The resulting logging measurements may be stored and/or processed, for example, by the control system (114), to generate corresponding well logs (140) for the well (102). A well log may include, for example, a plot of a logging response time versus true vertical depth (TVD) across the depth interval (130) of the wellbore (104).

In some embodiments, the one or more logging tools (113) includes a caliper logging tool. For example, a caliper logging tool may include hardware to determine a diameter of a borehole along its depth. In particular, a caliper logging tool may measure variation in borehole diameters as the logging tool is withdrawn from the bottom of a borehole, using two or more articulated arms that push against the borehole wall. An articulated arm may be connected to a potentiometer that causes resistance to change as the diameter of the borehole changes, resulting in varying electrical signals that correspond to changes to diameter. After calibration, the caliper logging tool may generate a caliper log that is printed as a continuous series of hole diameter values or radius values with respect to depth.

Moreover, some caliper logging tools may use electromagnetic techniques or acoustic techniques to determine diameter sizes. For electromagnetic sensing techniques, a caliper logging tool may include a coil centered inside a tubular that generates an alternating magnetic field and another coil farther up the logging tool that measures phase shift introduced by the tubular. For acoustic sensing techniques, a caliper logging tool may include a transducer that detects a high-frequency pulse reflected from a tubular or a borehole wall back to the transducer. As such, a diameter measurement may be determined from the time of flight of this reflected wave and a fluid's acoustic velocity.

In some embodiments, a caliper logging tool is a multifinger caliper. For an irregularly-shaped wellbore, a multifinger caliper may simultaneously determine diameters at several different locations. Within casing pipe and using a large number of arms (also called "fingers"), the caliper logging tool may detect small changes in the wall of the pipe. For illustration purposes, a multifinger caliper may have between 20 and 80 fingers (in comparison to caliper logging tools with 2 or 4 fingers), where such larger numbers of fingers may be used in larger pipes. Thus, a caliper logging tool may detect deformations, scale buildup, and/or metal loss due to corrosion. In some embodiments, a caliper logging tool is a smart caliper tool. For example, a caliper logging tool may generate a caliper log during a measurement-while-drilling (MWD) operation. A smart caliper tool may use ultrasonic caliper measurement techniques to account for bottom-hole assembly (BHA) placement and changes in fluid density. As such, a smart caliper tool may include hardware for onboard calibration and multiple sensors that allow 360° mapping of a wellbore or tubular shape.

Furthermore, scales may form within one or more tube sections of the wellbore (104). For example, a scale may be a mineral deposit that occurs on wellbore tubulars (e.g., casing, production tubulars, etc.) and other well components due to exposure of well fluids, changing temperatures, and different pressure conditions in the production conduit. The formation of scale may affect the performance of downhole tools such as artificial lift equipment. In addition, scales may interfere with the safe operation of pipeline valve systems and rapidly erodes surface chokes because of the high erosion rate when certain chemical compositions flow with a production stream. Thus, scales may result in restrictions, or even a plug, within a wellbore tubular and other well equipment. Examples of different scaling types include iron sulfide scaling (e.g., that results in iron sulfide or iron oxide deposits), carbonate scaling (e.g., resulting in calcium carbonate or calcite deposits), sulfate scaling (e.g., resulting in gypsum or anhydrite deposits), silica scaling (e.g., resulting chalcedony or amorphous opal deposits), and/or chloride scaling (e.g., resulting in sodium chloride deposits).

To remove scales, one or more well intervention operations may be performed in the wellbore (104). Where iron sulfide scales precipitate in a production well or a water injection well, for example, iron sulfide scales may be removed with a chemical scale treatment, such as a treatment that uses hydrochlroric acid in conjunction with sequestering or reducing agents to dissolve the scales. For chemical scale treatments, different solvents may be used depending on the type of scale. In particular, carbonate scales may also be dissolved using hydrochloric acid at specific temperatures, while sulfate scales may be removed using ethylenediamine tetraacetic acid. Chloride scales may be eliminated using fresh water or weak acidic solutions, such as solutions that include acetic acid. Silica scaling that is associated with steam flooding operations may be dissolved with hydrofluoric acid.

Scale treatments may also include mechanical treatments. In some embodiments, for example, coil tubing (CT) milling and high-pressure rotary jetting tools are used to remove scales. Abrasive jetting may cut scales while leaves a corresponding well tubular undamaged. A well intervention operation for a mechanical treatment may use various deployment mechanisms, such as a derrick or a coiled tubing truck to implement a workstring for performing the mechanical treatment within a well. In some embodiments, both chemical and mechanical treatments are used to remove scales (e.g., for iron sulfide scaling, a hydrochloric acid treatment may be used to remove FeS, while a mechanical treatment may be used to remove $FeS_2$).

Some well intervention operations also include scale-inhibition treatments. More specifically, a scale-inhibition treatment may include applying a chemical inhibitor into a water-producing zone for subsequent commingling with produced fluids, thereby preventing scale precipitation. Scale inhibitors may include various chemicals that delay, reduce and/or prevent scale deposition, such as acrylic acid polymers, maleic acid polymers, and phosphonates. In some embodiments, scale-inhibition treatments are performed using continuous injection into a wellbore via a tubing string that may reach various well perforations or injection into a gas lift system. Likewise, a scale inhibitor may be disposed in a rathole (i.e., an additional hole drilled at the end of the well beyond a final zone of interest) to implement a slow dissolution of the scale inhibitor.

Turning to simulator (160), a simulator (160) may include hardware and/or software with functionality for storing and analyzing well logs (140), such as caliper logs, to generate and/or update one or more descaling models (170). While the simulator (160) is shown at a well site, in some embodiments, the simulator (160) may be remote from a well site. In some embodiments, the simulator (160) is implemented as part of a software platform for the control system (114). The software platform may obtain data acquired by the drilling system (110) and logging system (112) as inputs, which may include multiple data types from multiple sources. The software platform may aggregate the data from these systems (110, 112) in real time for rapid analysis. In some embodiments, the control system (114), the logging system (112), and/or the simulator (160) may include a computer system that is similar to the computer system (602) described below with regard to FIG. 6 and the accompanying description.

In some embodiments, a descaling model (e.g., one of the descaling models (170)) is used to predict results of a scale treatment in a well. For example, a descaling model may be a linear regression model that predicts inner diameters of a tubular following a predetermined scale treatment. In some embodiments, a descaling model uses acquired caliper logs to produce a virtual caliper log or synthetic caliper log prior to actual performance of a descaling job. Thus, a descaling model may be an algorithmic model that may include functionality for determining the success or failure of a particular scale treatment. In some embodiments, a descaling model is a machine-learning model that is trained to predict caliper log values. Examples of machine-learning models include convolutional neural networks, deep neural networks, recurrent neural networks, support vector machines, decision trees, inductive learning models, deductive learning models, supervised learning models, etc.

In some embodiments, a control system (114) may communicate commands to one or more well systems based on caliper log data and a descaling model (e.g., one of the descaling models (170)). For example, the control system (114) may generate one or more control signals for positioning a workstring in the wellbore (104) or a jetting tool at a downhole end for cleaning operations. Likewise, a simulator (160) may communicate replacement operations or scale treatment operations to one or more control systems based on predicted caliper log values from one or more descaling models. For example, in response to a simulator (160) determining that a descaling treatment satisfies one or more predetermined criteria, a control system may implement the respective scale treatment. In contrast, where the simulator (160) determines that a scale treatment fails to satisfy a predetermined criterion, a control system may select a different scale treatment or a tubular replacement. Upon determining well tubular(s) that require replacement, casing or a production tubular may be removed from the wellbore (104) and a new tubular inserted accordingly. Depending on the type of well tubular, a cementing operation may be performed that includes pumping cement slurry into the wellbore (104) to displace existing well fluid and fill space between the well tubular and the untreated sides of the wellbore (104). Thus, a control system may transmit commands to mixers and storage tanks for managing cement slurry (e.g., a mixture of various additives and cement) for a corresponding well intervention operation.

While FIG. 1 shows various configurations of components, other configurations may be used without departing from the scope of the disclosure. For example, various components in FIG. 1 may be combined to create a single component. As another example, the functionality performed by a single component may be performed by two or more components.

Figure 2:
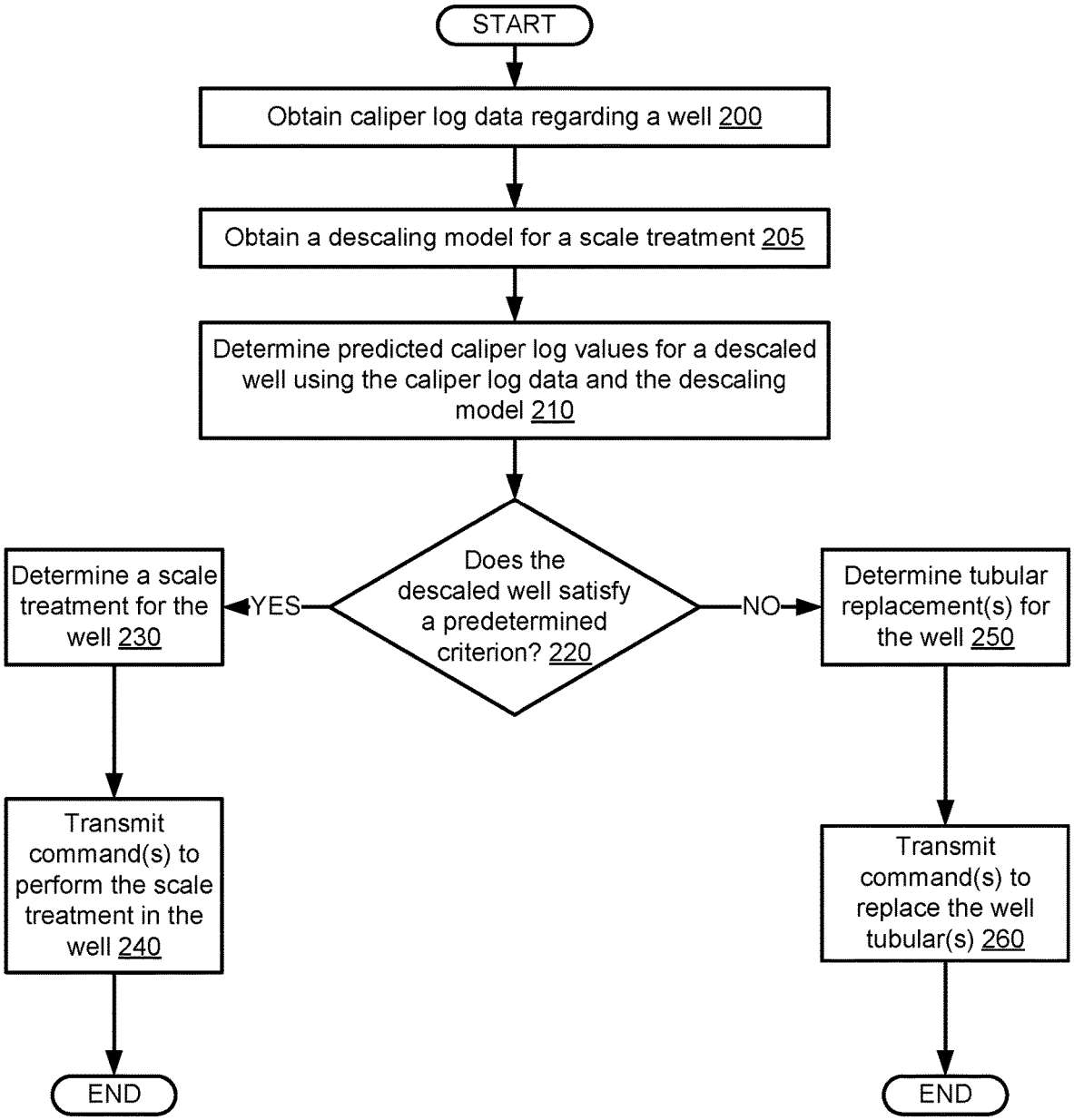
FIG. 2 shows a flowchart in accordance with one or more embodiments.

Turning to FIG. 2, FIG. 2 shows a flowchart in accordance with one or more embodiments. Specifically, FIG. 2 describes a general method for predicting results of one or more scale treatments. One or more blocks in FIG. 2 may be performed by one or more components (e.g., simulator (160)) as described in FIG. 1. While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 200, caliper log data are obtained regarding a well in accordance with one or more embodiments. For example, caliper log data may be obtained from various databases, preprocessed, and/or formatted for further analysis. In some embodiments, caliper log data correspond to one or more well logs that are acquired using a caliper logging tool, such as a multifinger caliper tool. For more information on caliper logging tools, see caliper logs and caliper loggings tools described above in FIG. 1 and the accompanying description.

In Block 205, a descaling model is obtained for a scale treatment in accordance with one or more embodiments. In some embodiments, a descaling model may be a model for a well or an oil and gas field that describes the effect of one or more scale treatments based on input caliper log data. For example, caliper logs may be acquired frequently in some wells to identify tubing scale obstructions and following scale treatments. As such, a descaling model may use caliper log data to predict the properties of scaled joints following a scale treatment, such as inner diameter values or radius values. In other words, a descaling model may output various values relating to a respective joint after descaling, e.g., a minimum radius value, a maximum radius value, and an average radius value. Likewise, multiple descaling models may be used for different scale treatments and/or different types of wells. For example, scale composition may be dependent on a specific reservoir type or well type. In some embodiments, a descaling model is further calibrated to a predetermined accuracy (e.g., accurate above 80%).

Furthermore, a descaling model may be a regression model that is generated using a linear regression analysis. In some embodiments, for example, a descaling model is expressed using the following equation:

$$Y=\propto+\beta_1X_1+\beta_2X_2+\beta_3X_3+\epsilon \qquad \text{Equation 1}$$

where Y is the response variable, such as an average radius postscale treatment, $\propto$ is an intercept term, $X_{1,2,3}$ are explanatory variables or predictor variables (e.g., maximum radius, minimum radius, and average radius), $\beta_{1,2,3}$ correspond to various slopes that indicate an increase or decreasing associated with a single unit increase in the explanatory variables, and $\epsilon$ is a random error term. Thus, a descaling model similar to Equation 1 may be generated using caliper log data from various wells.

Figure 3:
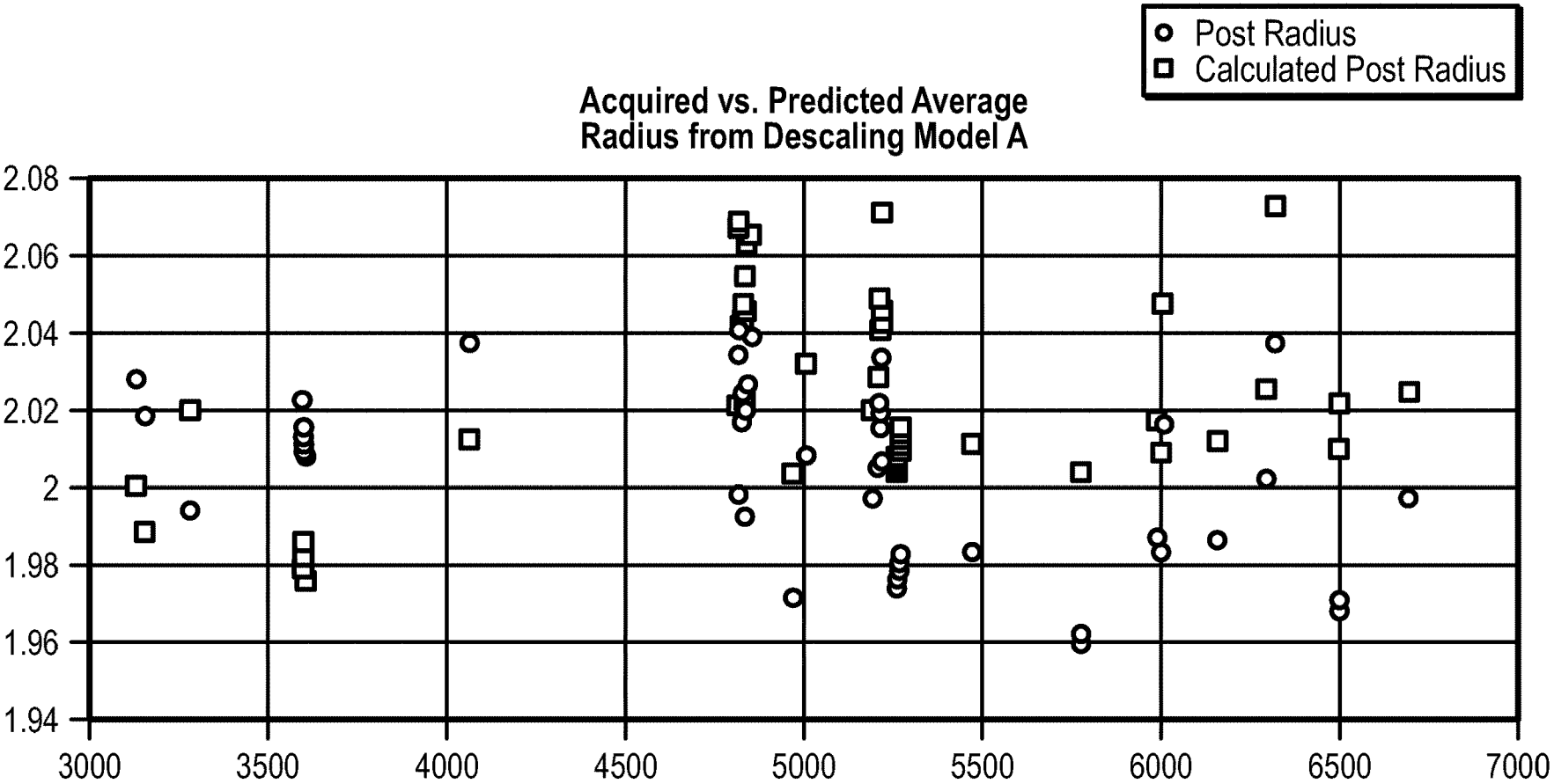
FIGS. 3, 4, and 5 show examples in accordance with one or more embodiments.

Turning to FIG. 3, FIG. 3 provides an example of a descaling model in accordance with one or more embodiments. The following example is for explanatory purposes only and not intended to limit the scope of the disclosed technology. In FIG. 3, descaling model A is a regression model based on a 4.5" tubing size for iron sulfide scaling. In some embodiments, descaling models are generated for different tubing sizes, such that different types of well tubulars may experience different results from scale treatments. To generate the descaling model A, caliper log data is obtained for various scaled wells with a similar well tubular. Thus, this caliper log data correspond to data that describes both the scaled wells before and after the particular scale treatment. Using this caliper log data, the descaling model A is generated using the variables that are available from backward selection. Next, a p-value is used to select variables that have stronger relationships between the predictor variables and the response variable. In other words, the p-value may test a null hypothesis such that a coefficient equal to zero has no effect. In other words, a low p-value (e.g., less than 0.05) may indicate that a null hypothesis can be rejected (i.e., a predictor variable with a low p-value is a meaningful addition to a descaling model), while a predictor variable with a high p-value is a statistically insignificant addition because a high p-value suggests that changes in a predictor variable are independent of changes in a response variable.

Accordingly, a variable selection method for descaling model A may achieve an objective of forming a model that predicts an average inner diameter of joints following a scale treatment. Finally, caliper log data is calibrated in order to select relevant caliper measurements at different joints. Thus, data calibration may provide the best predictors of inner diameters following a scale treatment. In FIG. 3, more than 1200 depth points are used to fit the descaling model A to caliper log data with a total of 14884 data points. After a history matching calibration, the descaling model A predicted 92% of 650 data point within 10% accuracy as illustrated in the graph in FIG. 3. The descaling model A may include the following coefficients based on a linear regression analysis: an intercept value of 2.922307755, a pre-treatment maximum radius value of −0.02928276, a pre-treatment minimum radius value of −0.056929242, and a pre-treatment average radius value of −0.390300302. For example, these coefficients may correspond to the $\propto$ value and the $\beta_{1,2,3}$ values in Equation 1 above, respectively.

Returning to FIG. 2, in Block 210, various predicted caliper log values are determined for a descaled well using caliper log data and a descaling model in accordance with one or more embodiments. In particular, the descaled well may be a predicted well based on the well in Block 200 e.g., where values for the predicted well are determined using one or more descaling models. Thus, the descaled well may described a prediction of values that may exist for a well following one or more scale treatments. After obtaining a descaling model, for example, pre-treatment caliper log data may be input for various scaled joints that are targeted for scale removal. Thus, the output of the descaled model may include various predicted caliper log values for the same joints. In some embodiments, a descaling model outputs other types of scale treatment information instead of predicted caliper log values, e.g., whether the descaled joint passes a pressure burst criterion.

Moreover, the predicted caliper log values may be presented in a log visualization tool, such as one implemented using a graphical user interface within a user device. For example, a simulator may generate a synthetic or virtual caliper log for a particular well that describes the results of a scale treatment. However, the predicted caliper log values may also be merely measurement values (e.g., minimum radius value, maximum radius value, average radius value, etc.) in a table or other format that are used for further processing by a simulator.

In Block 220, a determination is made whether a descaled well satisfies a predetermined criterion in accordance with one or embodiments. More specifically, various predicted caliper log values may be used in a tubing condition evaluation after de-scaling. Examples of predetermined criteria for a well tubular may include pipe pressure thresholds, physical dimensions (e.g., is the change in well tubular thickness sufficient for a desired purpose, such as a specific well integrity), changes in well productivity (e.g., does the resulting thickness after a scale treatment increase well productivity beyond a desired amount additional productivity), etc. For example, the predetermined criterion may correspond to a pressure rating of one or more well tubulars within the descaled well. In some embodiments, for example, a simulator updates a maximum allowable operating pressure (MAOP) for one or more joints among various well tubulars. Where the predicted descaled well satisfies the predetermined criterion, this process may proceed to Block 230. Where the predicted descaled well fails to satisfy the predetermined criterion, this process may proceed to Block 250.

Figure 4:
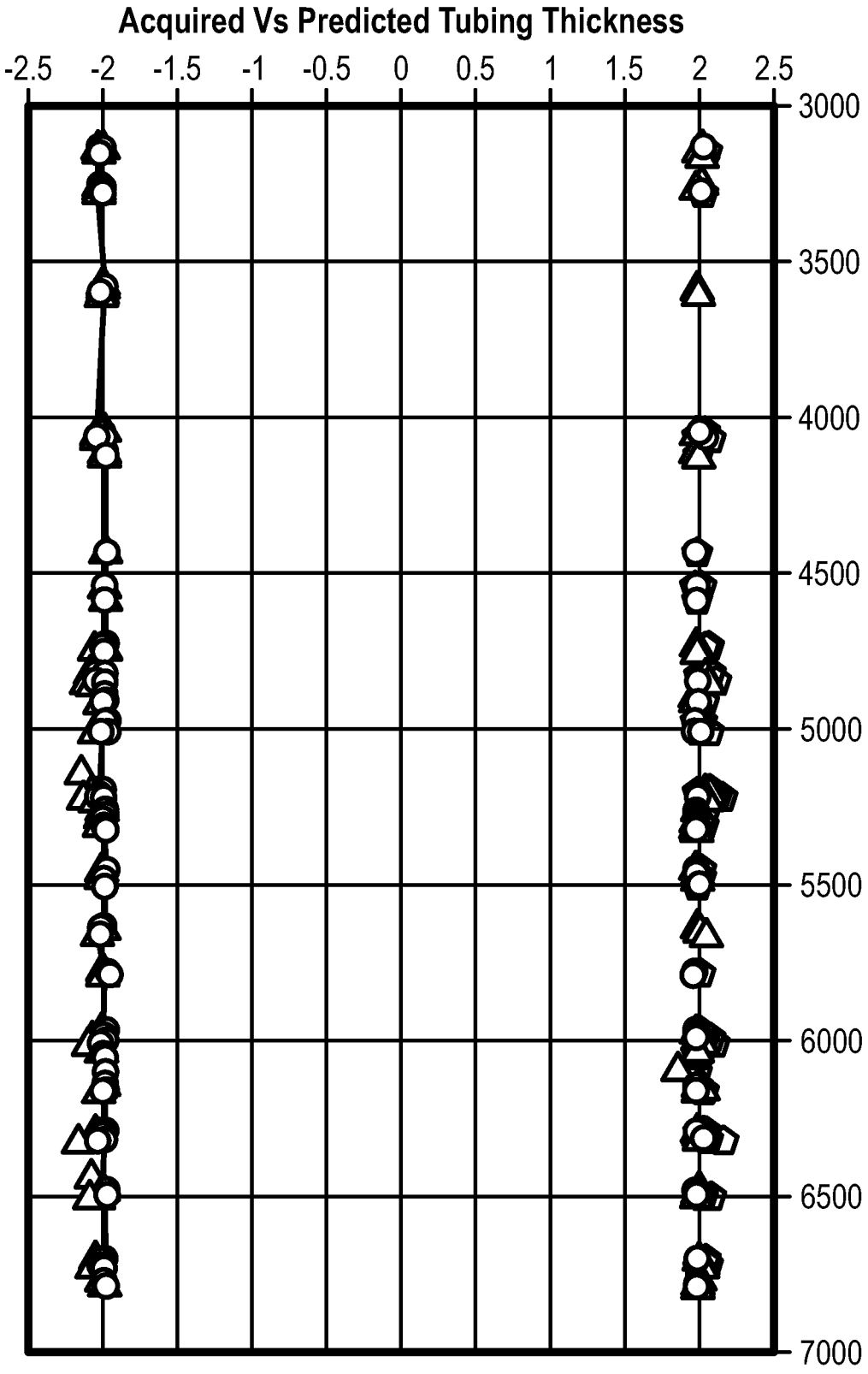

In some embodiments, a predetermined criterion may be based on post-treatment radius of one or more well tubulars. For example, a predicted radius value may be converted to a thickness measurement using the following equation:

$$\text{Thickness} = \frac{(\text{average radius} * 2) - OD}{2} \qquad \text{Equation 2}$$

where the average radius corresponds to a value at a predetermined well location and OD corresponds to an outer diameter value of a particular well tubular. In FIG. 4, a virtual caliper log is illustrated that describes various wellbore thicknesses between predicted caliper log values and acquired caliper log data.

Figure 5:
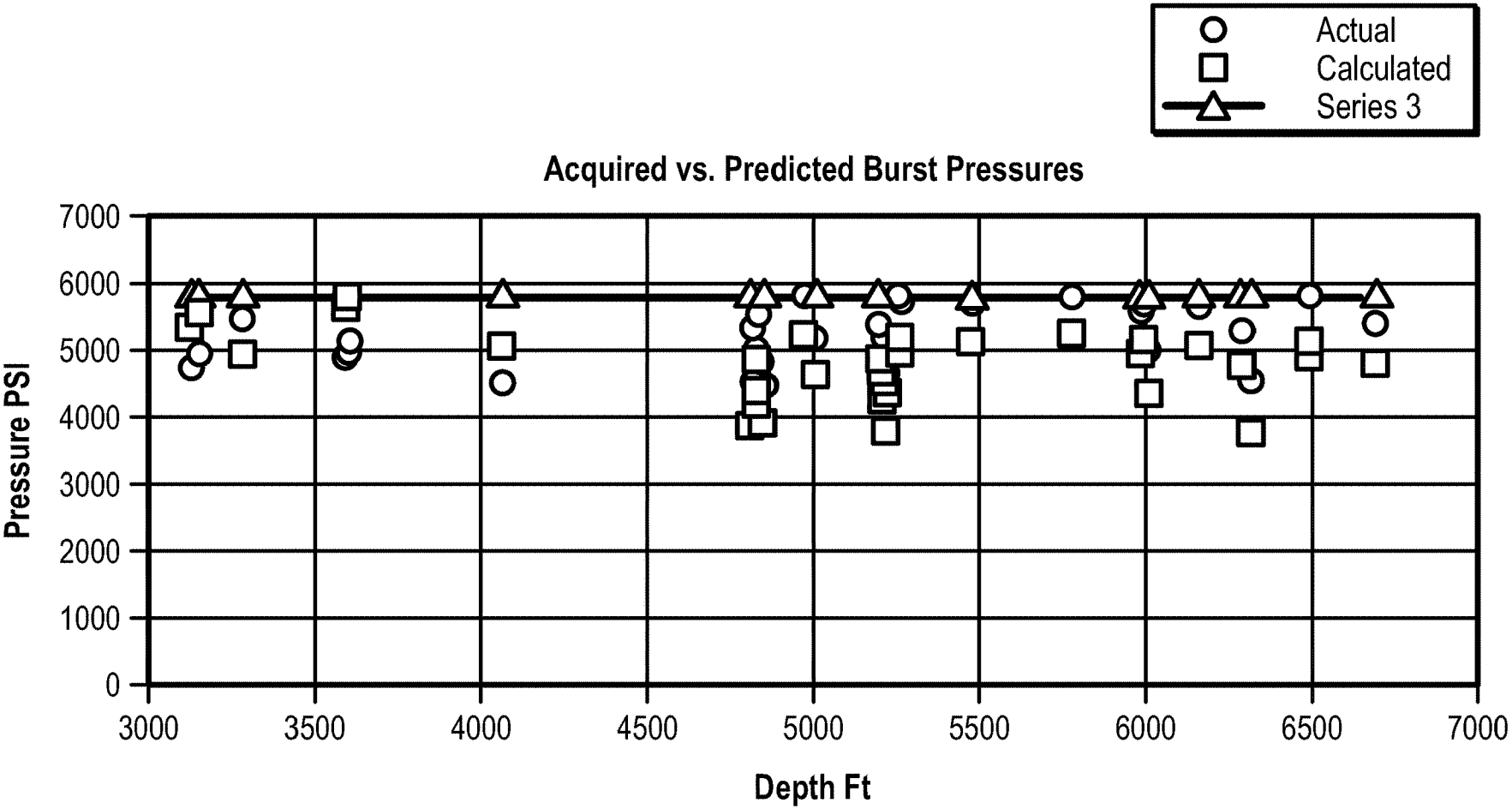

In some embodiments, a burst pressure is determined using one or more thickness values of one or more well tubulars. A burst pressure value may correspond to a mechanical strength limit of a well tubular, where the burst pressure may identify a pressure that exceeds the tensile strength of a tubing material. Thus, a burst pressure may be determined based on a tensile strength of a tubing polymer as well as the tubing wall thickness value (e.g., the thickness value determined in Equation 2 above). In some embodiments, burst pressure is determined using the following equation:

$$P_b = 0.875 * \frac{2 * Y_p * t}{D} \qquad \text{Equation 3}$$

where $P_b$ corresponds to a minimum internal yield pressure (e.g., as measured in psi), $Y_p$ corresponds to a minimum yield strength (e.g., as measured in psi), t corresponds to a nominal wall thickness (e.g., in inches), and D corresponds to a nominal outside diameter of the pipe (e.g., in inches). In FIG. 5, a comparison is illustrated that shows burst pressure values from predicted data and burst pressures obtained from acquired data. The lowest measured burst pressure may be set as a new maximum allowable operating pressure (MAOP) for a well. Thus, MAOP values may differ between a well analyzed with a caliper logging tool and the same well after a descaling treatment.

Furthermore, some embodiments may automate a decision-making process for performing and analyzing descaling jobs on one or more wells. A simulator may determine which descaling tasks result in a tubular rating becomes compromised after a particular scale treatment. Where a scale treatment compromises a well component instead of improving well performance, for example, a workover may be performed on the corresponding well component instead. Thus, some embodiments are integrated in various well intervention operations to manage control systems, well delivery schedules, and other well operations.

In Block 230, a scale treatment is determined for a well in accordance with one or more embodiments. The scale treatment may be similar to one of the scale treatments described above in FIG. 1 and the accompanying description. In particular, multiple scale treatments with different parameters may be available to remove a particular type of scale. Thus, predicted caliper log values from different descaling models may be used to determine which scale treatment to use. In some embodiments, parameters of a scale treatment are tailored to a particular well based on the results of the predicted caliper log values.

In Block 240, one or more commands are transmitted to perform a scale treatment in a well in accordance with one or more embodiments. For example, one or more control systems may be used to implemented one or more scale treatments. Thus, a control system may transmit one or more commands to one or more well components to implement the scale treatment determined in Block 230. Such commands may be used to manage a well delivery schedule regarding one or more wells. Likewise, commands may also be transmitted over a well network, e.g., as part of an automation algorithm for one or more well intervention operations.

In Block 250, one or more tubular replacements are determined for a well in accordance with one or more embodiments. Where the resulting descaled well fails to be suitable for future well operations, a corresponding tubular replacement operation may be implemented. Accordingly, a replacement operation may use the existing well design parameters, or adjust them accordingly based on changes to the well.

In Block 260, one or more commands are transmitted based on one or more tubular replacements in accordance with one or more embodiments. For example, commands may be transmitted to implement a well replacement operation in a similar manner as the commands described above in Block 240 and the accompanying description.

Figure 6:
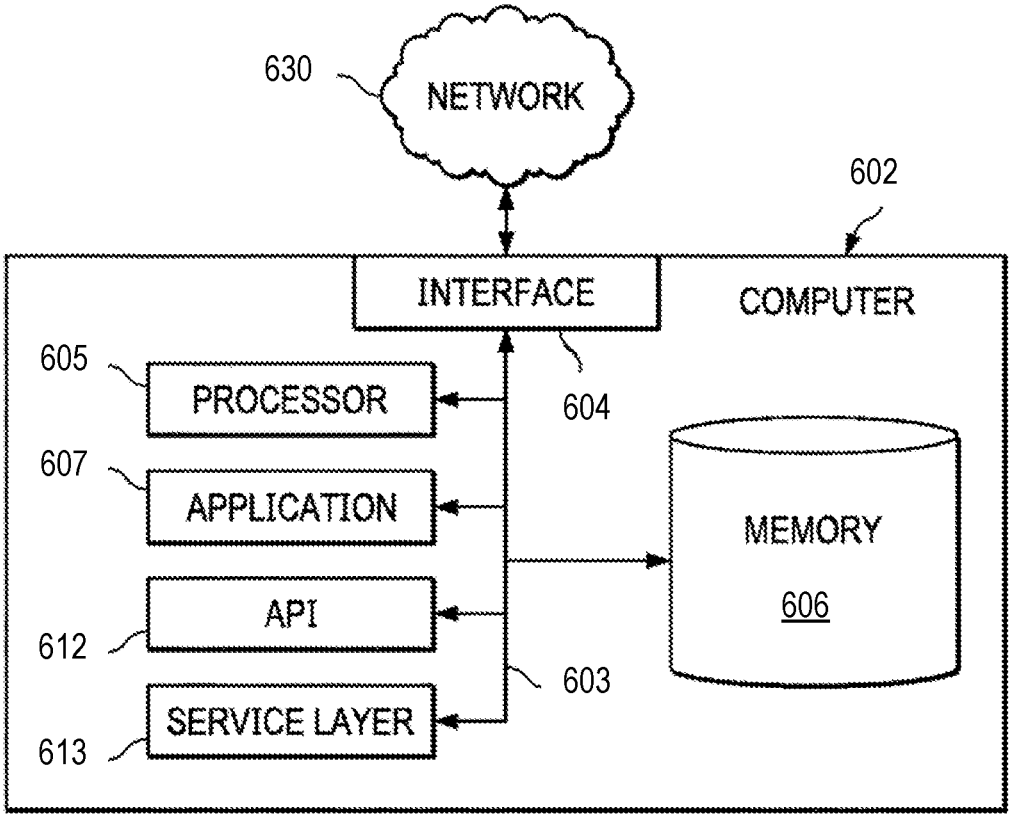
FIG. 6 shows a computer system in accordance with one or more embodiments.

Embodiments may be implemented on a computer system. FIG. 6 is a block diagram of a computer system (602) used to provide computational functionalities associated with described algorithms, methods, functions, processes, flows, and procedures as described in the instant disclosure, according to an implementation. The illustrated computer (602) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (602) may include a computer that includes an input device, such as a keypad, keyboard, touch screen, or other device that can accept user information, and an output device that conveys information associated with the operation of the computer (602), including digital data, visual, or audio information (or a combination of information), or a GUI.

The computer (602) can serve in a role as a client, network component, a server, a database or other persistency, or any other component (or a combination of roles) of a computer system for performing the subject matter described in the instant disclosure. The illustrated computer (602) is communicably coupled with a network (630). In some implementations, one or more components of the computer (602) may be configured to operate within environments, including cloud-computing-based, local, global, or other environment (or a combination of environments).

At a high level, the computer (602) is an electronic computing device operable to receive, transmit, process, store, or manage data and information associated with the described subject matter. According to some implementations, the computer (602) may also include or be communicably coupled with an application server, e-mail server, web server, caching server, streaming data server, business intelligence (BI) server, or other server (or a combination of servers).

The computer (602) can receive requests over network (630) from a client application (for example, executing on another computer (602)) and responding to the received requests by processing the said requests in an appropriate software application. In addition, requests may also be sent to the computer (602) from internal users (for example, from a command console or by other appropriate access method), external or third-parties, other automated applications, as well as any other appropriate entities, individuals, systems, or computers.

Each of the components of the computer (602) can communicate using a system bus (603). In some implementations, any or all of the components of the computer (602), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (602) or other components (whether or not illustrated) that are communicably coupled to the computer (602). The functionality of the computer (602) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or other suitable format. While illustrated as an integrated component of the computer (602), alternative implementations may illustrate the API (612) or the service layer (613) as stand-alone components in relation to other components of the computer (602) or other components (whether or not illustrated) that are communicably coupled to the computer (602). Moreover, any or all parts of the API (612) or the service layer (613) may be implemented as child or sub-modules of another software module, enterprise application, or hardware module without departing from the scope of this disclosure.

The computer (602) includes an interface (604). Although illustrated as a single interface (604) in FIG. 6, two or more interfaces (604) may be used according to particular needs, desires, or particular implementations of the computer (602). The interface (604) is used by the computer (602) for communicating with other systems in a distributed environment that are connected to the network (630). Generally, the interface (604 includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (602).

The computer (602) includes at least one computer processor (605). Although illustrated as a single computer processor (605) in FIG. 6, two or more processors may be used according to particular needs, desires, or particular implementations of the computer (602). Generally, the computer processor (605) executes instructions and manipulates data to perform the operations of the computer (602) and any algorithms, methods, functions, processes, flows, and procedures as described in the instant disclosure.

The computer (602) also includes a memory (606) that holds data for the computer (602) or other components (or a combination of both) that can be connected to the network (630). For example, memory (606) can be a database storing data consistent with this disclosure. Although illustrated as a single memory (606) in FIG. 6, two or more memories may be used according to particular needs, desires, or particular implementations of the computer (602) and the described functionality. While memory (606) is illustrated as an integral component of the computer (602), in alternative implementations, memory (606) can be external to the computer (602).

The application (607) is an algorithmic software engine providing functionality according to particular needs, desires, or particular implementations of the computer (602), particularly with respect to functionality described in this disclosure. For example, application (607) can serve as one or more components, modules, applications, etc. Further, although illustrated as a single application (607), the application (607) may be implemented as multiple applications (607) on the computer (602). In addition, although illustrated as integral to the computer (602), in alternative implementations, the application (607) can be external to the computer (602).

There may be any number of computers (602) associated with, or external to, a computer system containing computer (602), each computer (602) communicating over network (630). Further, the term "client," "user," and other appropriate terminology may be used interchangeably as appropriate without departing from the scope of this disclosure. Moreover, this disclosure contemplates that many users may use one computer (602), or that one user may use multiple computers (602).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining, by a computer processor, caliper log data regarding a first well comprising a plurality of tubulars, wherein the caliper log data corresponds to a portion of a caliper log that is acquired using a caliper logging tool in the first well with the plurality of tubulars;

determining, by the computer processor and using a first descaling model and the caliper log data, a plurality of predicted caliper log values for a descaled well, wherein the descaled well corresponds to the first well following a first scale treatment, wherein the first descaling model is a linear regression model that is determined using a plurality of caliper logs based on a plurality of wells, and wherein the plurality of predicted caliper log values correspond to a prediction of a diameter of one or more joints in the first well following the first scale treatment;

determining, by the computer processor, whether the descaled well satisfies a predetermined criterion based on the plurality of predicted caliper log values, wherein the predetermined criterion is selected from a group consisting of a pressure threshold of a tubular, a physical dimension of a thickness of the tubular, a maximum allowable operating pressure of the tubular, and a predetermined change in well productivity for the first well;

determining, by the computer processor and in response to determining that the descaled well fails to satisfy the predetermined criterion, a tubular replacement for the first well; and transmitting, by the computer processor and to a control system, a command that implements the tubular replacement, wherein the tubular replacement corresponds to a change of at least one tubular among the plurality of tubulars to a different tubular in the first well.

2. The method of claim 1, wherein the first descaling model obtains a plurality of radius values for a plurality of scaled joints among the plurality of tubulars as inputs, and wherein the first descaling model outputs at least one predicted caliber log value for the descaled well based on the inputs.

3. The method of claim 1, wherein the first descaling model comprises:

an average radius post-treatment as a response variable, a plurality of explanatory variables corresponding to a maximum radius, a minimum radius, and an average radius of one or more scaled joints in the first well, an intercept term, and a random error term.

4. The method of claim 1, further comprising:

determining, by the computer processor and using the plurality of predicted caliper log values, a plurality of casing burst pressures for a plurality of joints in the descaled well; and determining, by the computer processor, a maximum allowable operating pressure (MAOP) value for the descaled well using the plurality of casing burst pressures, wherein the MAOP value corresponds to a joint among the plurality of joints with a lowest casing burst pressure among the plurality of casing burst pressures, and wherein the predetermined criterion is a threshold based on the MAOP value.

5. The method of claim 1, further comprising:

obtaining a plurality of descaling models for a plurality of different scale treatments;

determining a second scale treatment for a second well among the plurality of different scale treatments; and selecting a second descaling model among the plurality of descaling models in response to determining the second scale treatment.

6. The method of claim 1, further comprising:

generating, using the first descaling model, a synthetic caliber log for the descaled well.

7. The method of claim 1, wherein the first scale treatment is a treatment that removes iron sulfide scales.

8. The method of claim 1, wherein the first scale treatment is selected from a group consisting of a hydrochloric acid treatment, an ethylenediamine tetraacetic acid treatment, an acetic acid treatment, and a mechanical treatment.

9. A method, comprising:

obtaining, by a computer processor, caliper log data regarding a first well comprising a plurality of tubulars, wherein the caliper log data corresponds to a portion of a caliper log that is acquired using a caliper logging tool in the first well with the plurality of tubulars;

determining, by the computer processor and using a descaling model and the caliper log data, a plurality of predicted caliper log values for a descaled well, wherein the descaled well corresponds to the well following a first scale treatment, wherein the first descaling model is a linear regression model that is determined using a plurality of caliper logs based on a plurality of wells, and wherein the plurality of predicted caliper log values correspond to a prediction of a diameter of one or more joints in the first well following the first scale treatment;

determining, by the computer processor, whether the descaled well satisfies a predetermined criterion based on the plurality of predicted caliper log values, wherein the predetermined criterion is selected from a group consisting of a pressure threshold of a tubular, a physical dimension of a thickness of the tubular, a maximum allowable operating pressure of the tubular, and a predetermined change in well productivity for the first; and transmitting, by the computer processor, to a control system, and in response to determining that the descaled well satisfies the predetermined criterion, a command that implements the first scale treatment at the first well.

10. The method of claim 9, further comprising:

determining, by the computer processor and using the plurality of predicted caliper log values, a plurality of casing burst pressures for a plurality of joints in the descaled well; and determining, by the computer processor, a maximum allowable operating pressure (MAOP) value for the descaled well using the plurality of casing burst pressures, wherein the MAOP value corresponds to a joint among the plurality of joints with a lowest casing burst pressure among the plurality of casing burst pressures, and wherein the predetermined criterion is a threshold based on the MAOP value.

11. The method of claim 9, further comprising:

obtaining a plurality of descaling models for a plurality of different scale treatments;

determining a second scale treatment for a second well among the plurality of different scale treatments; and selecting a second descaling model among the plurality of descaling models in response to determining the second scale treatment.

12. The method of claim 9, further comprising:

generating, using the first descaling model, a synthetic caliber log for the descaled well.

13. The method of claim 9, wherein the first scale treatment is a treatment that removes iron sulfide scales.

14. The method of claim 9, wherein the first scale treatment is selected from a group consisting of a hydrochloric acid treatment, an ethylenediamine tetraacetic acid treatment, an acetic acid treatment, and a mechanical treatment.

15. A system, comprising:

a logging system coupled to a caliper logging tool and a well comprising a plurality of tubulars;

a control system coupled to the well; and a simulator comprising a computer processor, wherein the simulator is coupled to the logging system and the control system, the simulator comprising functionality for:

obtaining, using the caliper logging tool, caliper log data regarding the well, wherein the caliper log data corresponds to a portion of a caliper log that is acquired using the caliper logging tool in the well with the plurality of tubulars;

determining, using a descaling model and the caliper log data, a plurality of predicted caliper log values for a descaled well, wherein the descaled well corresponds to the well following a scale treatment, wherein the first descaling model is a linear regression model that is determined using a plurality of caliper logs based on a plurality of wells, and wherein the plurality of predicted caliper log values correspond to a prediction of a diameter of one or more joints in the first well following the first scale treatment;

determining whether the descaled well satisfies a predetermined criterion based on the plurality of predicted caliper log values, wherein the predetermined criterion is selected from a group consisting of a pressure threshold of a tubular, a physical dimension of a thickness of the tubular, a maximum allowable operating pressure of the tubular, and a predetermined change in well productivity for the first well;

transmitting, in response to determining that the descaled well satisfies the predetermined criterion, a first command to the control system to perform the scale treatment; and transmitting, to a control system and in response to determining that the descaled well fails to satisfy the predetermined criterion, a second command that implements a tubular replacement, wherein the tubular replacement corresponds to a change of at least one tubular to a different tubular among the plurality of tubulars in the well.

16. The system of claim 15, further comprising:

a second control system coupled to the simulator, wherein the second control system is configured for performing one or more scaled treatments that are selected from a group consisting of a hydrochloric acid treatment, an ethylenediamine tetraacetic acid treatment, an acetic acid treatment, and a mechanical treatment.

17. The system of claim 15, wherein the simulator further comprises functionality for:

determining, by the computer processor and using the plurality of predicted caliper log values, a plurality of casing burst pressures for a plurality of joints in the descaled well; and determining, by the computer processor, a maximum allowable operating pressure (MAOP) value for the descaled well using the plurality of casing burst pressures, wherein the MAOP value corresponds to a joint among the plurality of joints with a lowest casing burst pressure among the plurality of casing burst pressures, and wherein the predetermined criterion is a threshold based on the MAOP value.

18. The system of claim 15, wherein the scale treatment is a treatment that removes iron sulfide scales.

* * * * *